US006929526B1

(12) United States Patent
Cole et al.

(10) Patent No.: US 6,929,526 B1
(45) Date of Patent: Aug. 16, 2005

(54) PUPPET BOOK

(75) Inventors: Jeffrey C. Cole, Arvada, CO (US); Kenneth H. Fleck, Littleton, CO (US)

(73) Assignee: Accord Publishing, LTD, Denver, CO (US)

( * ) Notice: Subject to any disclaimer, the term of this patent is extended or adjusted under 35 U.S.C. 154(b) by 0 days.

(21) Appl. No.: 10/635,222

(22) Filed: Aug. 6, 2003

Related U.S. Application Data

(60) Provisional application No. 60/401,367, filed on Aug. 6, 2002.

(51) Int. Cl.[7] ..... A63H 3/14
(52) U.S. Cl. ..... 446/327; 446/72; 281/15.1
(58) Field of Search ..... 446/71, 83, 151, 446/148, 321, 327–329, 72; 434/317, 178; 281/15.1, 29, 36–38, 51

(56) References Cited

U.S. PATENT DOCUMENTS

| | | | | |
|---|---|---|---|---|
| 1,028,921 A * | 6/1912 | Wagner | 283/63.1 |
| 2,489,240 A * | 11/1949 | Meyer | 446/147 |
| 3,526,990 A * | 9/1970 | Edmonds | 446/327 |
| 3,778,925 A * | 12/1973 | Owen | 446/74 |
| 3,918,180 A * | 11/1975 | Chamberlin | 434/178 |
| 4,233,772 A * | 11/1980 | Hamar | 446/149 |
| 5,941,570 A * | 8/1999 | Cole et al. | 281/38 |
| 6,672,929 B2 * | 1/2004 | Leleu | 446/72 |

OTHER PUBLICATIONS

Figures A through D (4 pages) Different perspectives of Hide and Seek Snail Wobblebugs book written by Gaby Goldsack, illustrated by Sonia Canals, designed by Andrea Newton, published by Cowley Hunter Robinson Ltd, copyrighted 2001.

Photocopies of book entitled "Polly Pelican and her Big Beak" A Snappy Fun (TM) Book published by Joshua Morris Publishing, Inc., 355 Riverside Avenue, Westport, CT 86880, copyright 1997 Victoria House Publishing Ltd. (5 pages).

* cited by examiner

*Primary Examiner*—Jessica Harrison
*Assistant Examiner*—Bena Miller
(74) *Attorney, Agent, or Firm*—Aileen Law; Patent Law Offices of Rick Martin, P.C.

(57) ABSTRACT

A children's book having three-dimensional puppet elements that may appear coordinated with a variety of different characters with a variety of different facial expressions on each page of the book including the cover. Various characters and facial expressions are made possible because the three-dimensional puppet element appears in two parts with an illustratable gap in-between the two elements. With appropriate surrounding artwork, a unique and new three-dimensional effect is created which has never before been seen in a book. A reader can hold the book and animate the puppet elements with a right hand while turning the pages of the book with a left hand.

19 Claims, 8 Drawing Sheets

FIG 4
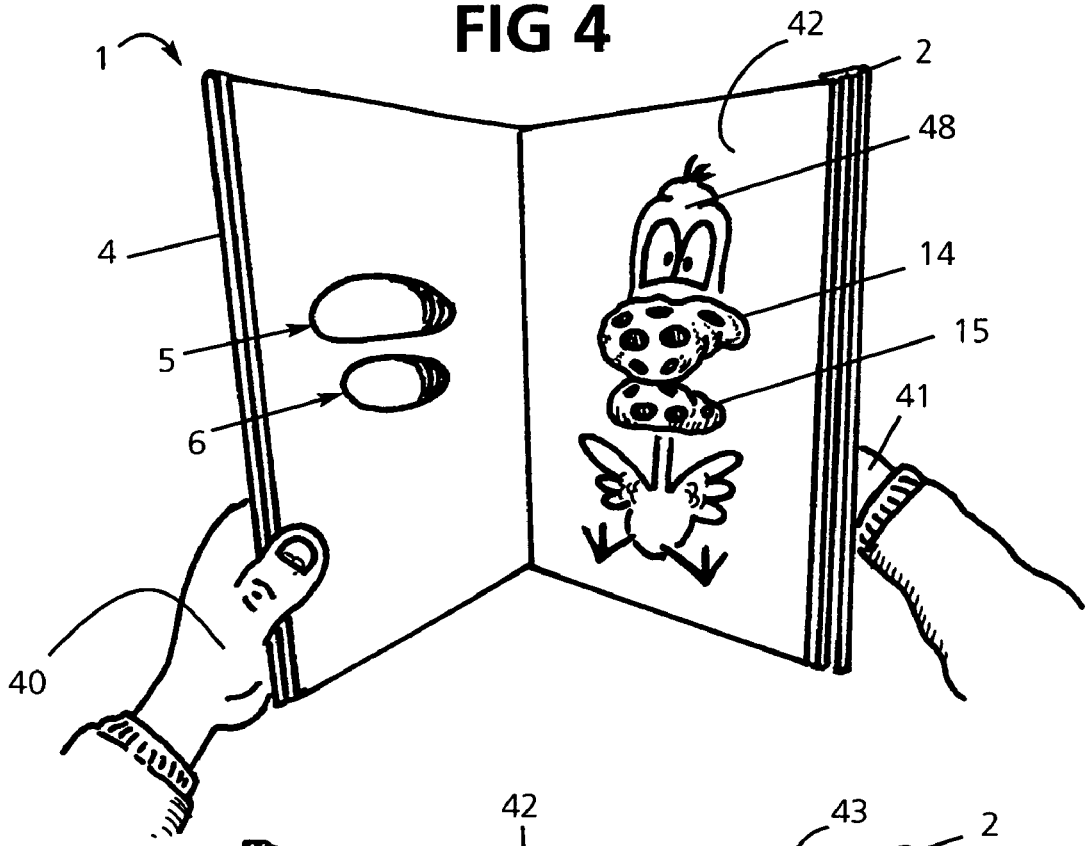
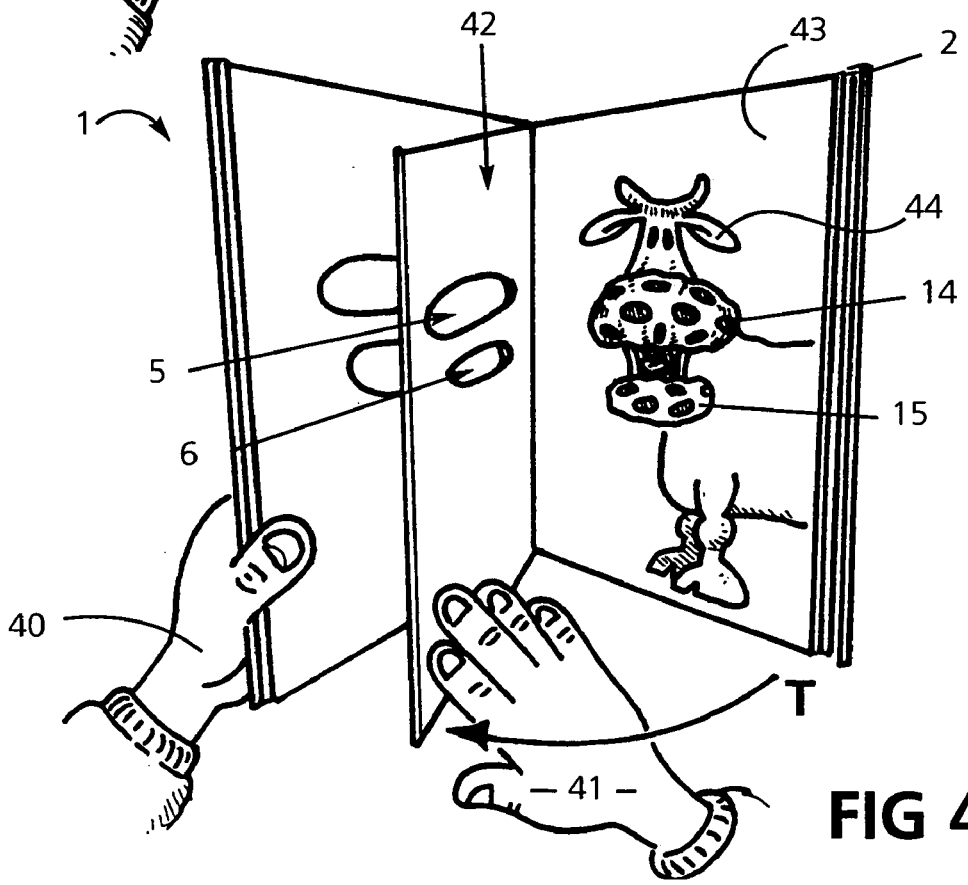
FIG 4A 803
804
801a
817
801b
80

903
904
901a
917
901b
90

1003
1004
1001a
1017
1001b
100

1103
1104
1101a
1117
1101b
110

801
817

901
917

1001
1017

1101
1117

PUPPET BOOK

CROSS REFERENCE APPLICATIONS

This application is a non-provisional application claiming the benefits of provisional application No. 60/401,367 filed Aug. 6, 2002.

FIELD OF INVENTION

The present invention relates generally to a puppet book, and in particular to a puppet book having a three-dimensional puppet element consisting of two parts thereby enabling a variety of animated puppet characters to appear on each page of a book and its cover.

BACKGROUND OF THE INVENTION

Known in the art is a book which is titled "Hide and Seek Snail Wobblebugs" published by Cowley Hunter Robinson Ltd., © 2001 by CHR Holdings Ltd., Bath, England. This book has a puppet character, a purple snail, mounted to the back cover and protruding through all the pages and out the front cover and beyond the front cover by about two inches. The child can insert his finger through the back of the book and wiggle the snail against a different background printed on each page. The snail does not form a part of a face on any of the pages because the snail has its own face.

Another relevant prior art children's book is disclosed in U.S. Pat. No. 4,233,772 (1980) to Hamar (Hamar '772). Hamar's book discloses one page of a book having a puppet element fastened to the page. The child can manipulate the puppet element with his fingers. Hamar '772 does not disclose holes through all the pages to allow a projection of the puppet elements all the way through the book. Hamar '772 does not teach a gap between the puppet elements which can be used to augment the face depicted on the page.

The present invention surpasses all known prior art in the amusement value to children. The present invention uses at least two puppet elements mounted to the rear cover of a book. Holes are made in all the pages as well as the front and back covers to enable the puppet elements to project out beyond the front cover of the book. A gap between the holes allows the book's artist to create a multitude of coordinated body and/or facial elements such as different tongues and teeth on each page within the gap area between the holes. Since each page has a different face and/or graphic depiction, the gap area serves to heighten the amusement value of every character depicted, thereby creating a thoroughly entertaining three-dimensional puppet book.

SUMMARY OF THE INVENTION

The main aspect of the present invention is to provide a three-dimensional puppet book having a puppet element that is able to appear as a variety of animated characters with a variety of facial expressions. A three-dimensional puppet element consisting of an upper part, a lower part, and a gap in between the upper and lower parts make a variety of animated character and facial expressions on all pages of the book, including the cover, possible.

Another aspect of the present invention is to create a gap between the puppet elements, wherein the gap can be decorated differently on each page.

Other aspects of this invention will appear from the following description and appended claims, reference being made to the accompanying drawings forming a part of this specification wherein like reference characters designate corresponding parts in the several views.

A children's book is shown having a three-dimensional mouth/nose element (referred to hereafter as "3-D Element") that is permanently attached to the back of a book. Said 3-D Element has two parts, an upper part and a lower part. Two die-cut holes throughout the book allow the upper and lower portion of the 3-D Element to be viewed on every page of the book. This 3-D Element makes it possible to present fully unique characters on the right hand pages as well as the cover of a book when the artwork surrounding the 3-D Element changes to illustrate new characters and/or facial expressions. The characters illustrated in conjunction with the 3-D Element may vary from human to animal to creature while the facial expressions may range from happy to sad to angry, etc. Accordingly, the reader may see the 3-D Element as different characters throughout the book as the pages are turned in a normal page flipping motion.

This invention also teaches how a "gap," created between the upper and lower parts of the 3-D Element, is used to uniquely enhance the three dimensional effect of the artwork surrounding the 3-D Element. Just as the 3-D Element and die-cut holes run throughout the book, so does the gap created between the die-cut holes. Preferably, the gap measures about 0.5" to about 2" from top to bottom. Said gap provides an area for the illustration of mouth features such as teeth, gums, tongue, tonsils, etc. coincident with the character depicted on the book cover or pages therein. These mouth features also make possible various facial expressions such as happy, sad, angry, etc.

There is a direct and corresponding relationship between the 3-D Element, the gap, and the area of the book surrounding the gap and 3-D Element. The combination of these elements make it possible for the 3-D Element to produce as many as ten different characters in a ten-page book, twenty different characters in a twenty-page book, and so forth. The ability to create new characters in conjunction with a three-dimensional element on every page of a book is unique and different to all other known book or "puppet" art forms. The prior art is limited to a single character throughout a book or, in the case of Hamar '772, is limited to a single page.

Both the upper and lower parts of the 3-D Element are hollow and preferably molded in one piece from a pliable plastic that may be covered with a fabric material. The 3-D Element may be operated as a puppet by inserting the reader's hand into the back of the book. The reader may operate the 3-D Element as a puppet without having to take his hand in and out of the 3-D element as pages are turned and/or the book is opened and closed. Conversely, Hamar '772 requires the reader to take his hand out before turning the page in which the element of Hamar '772 has been inserted.

The 3-D Element is designed to allow the books to stack, one on top of the other. The ability to stack is accomplished by designing a hollow 3-D Element that is shaped in such a way that the outer convex curve of one structure can insert into the inner concave curve of another identical structure. Accordingly, the books may be consolidated, thereby reducing the space needed to ship, shelve, and display two or more of the books. Further, books having the 3-D Element may optionally consist of different printed matter (i.e., different stories, different characters) and still be stackable.

The 3-D Element is made from plastic or pliable rubber material. The upper and lower elements can be manufactured as separate units or one piece and may conform to many different designs. The 3-D Element is sandwiched between paperboard stiffeners and glued to leave a seamless cosmetic finish. When the paper stiffeners are combined, they become the back cover of a book.

Structural toy books in the market commonly depict a single three-dimensional toy character attached to the front or back cover of a book. It is important to note that these designs are limited to a single, unchanging, and unchangeable character. Unlike the present invention, these single characters cannot change in composition, style, or expression. A dog character, for example, remains the same dog with the same expression on every changing page of the book—only the artwork surrounding the dog (i.e., the dog's environment/surroundings) is allowed to change, not the dog itself. There is, therefore, a need for a book having a structural toy element that can change in character and expressions with the turning of each page of the book. An invention such as this will regenerate the interest, personality, and charm of three-dimensional children's books as it provides a whole new visual experience and opportunity for storytelling.

In summary, the invention of a two-part, 3-D Element provides solutions that make it possible to create an interactive book previously unknown. Accordingly, this invention fills the following needs:

1) The need for a book having a structural toy element that when combined with appropriate surrounding artwork, can actually change in character and/or expressions with the turning of each page;
2) The need to accommodate the illustration of mouth parts and expressions between the upper and lower portions of a two-part, 3-D Element in the area that has been described herein as the gap;
3) The need for a (changing) three-dimensional element that is visible throughout an entire book and its cover;
4) The need for a (changing) three-dimensional element that can be operated on every page of the book (including the cover) without the reader having to remove their hand during the entire story reading;
5) The need for a 3-D Element that does not limit story writing to a single character;
6) The need for a two-part, 3-D Element that can be stacked (regardless of story content) one book on top of the other.

The two-part, 3-D Element described herein makes all of the above possible with the added benefit that it is relatively easy to manufacture as well as convenient and easy for the reader to operate.

BRIEF DESCRIPTION OF THE DRAWINGS

FIG. 3A is a front plan view of one page of the puppet book depicted in FIG. 3.

FIG. 3B is a front plan view of one page of the puppet book depicted in FIG. 3.

FIG. 3C is a front plan view of one page of the puppet book shown in FIG. 3.

FIG. 4 is a front perspective view of the puppet book of FIG. 1 being animated by a right hand of the user.

FIG. 4A is a front perspective view of the puppet book of FIG. 1 shown with the reader turning a page.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF THE DRAWINGS

Figure 1:
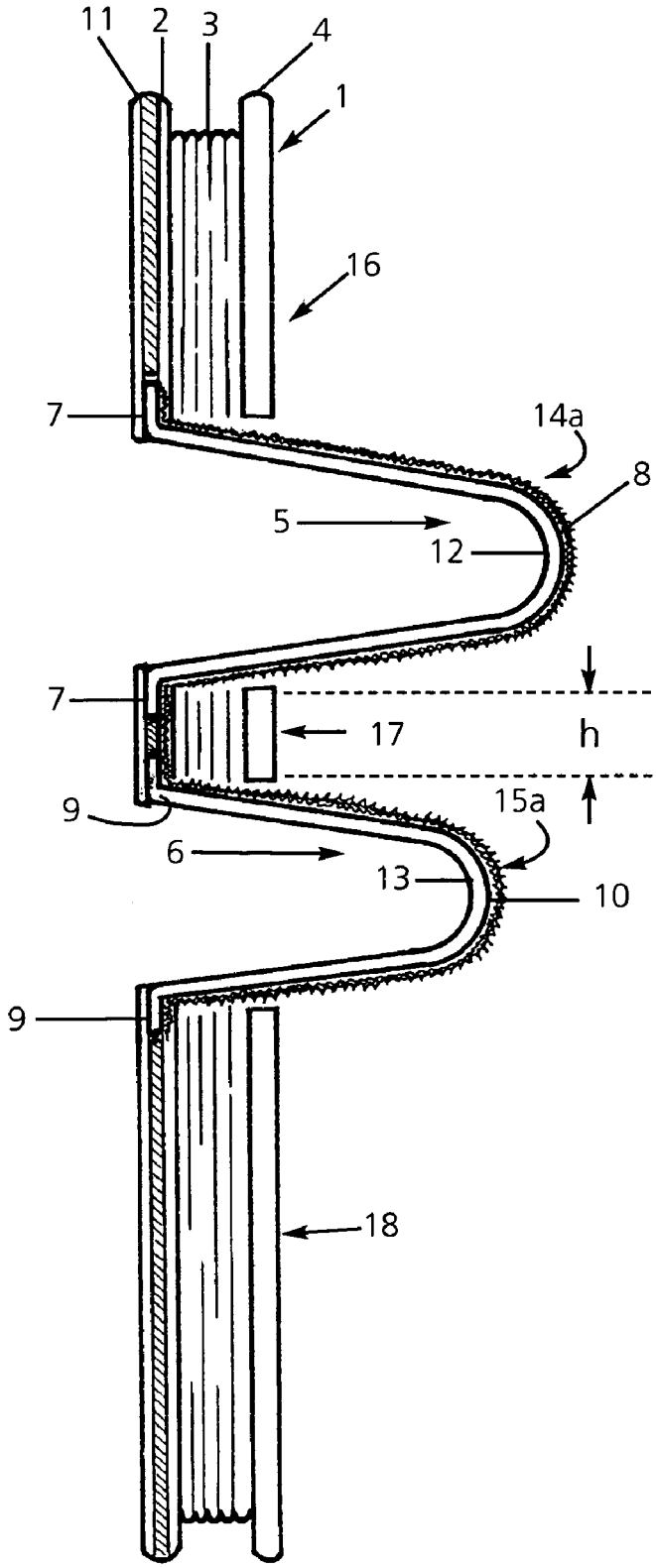
FIG. 1 is a longitudinal cross-sectional view of one embodiment of the puppet book.

Referring first to FIG. 1, a puppet book 1 is shown in cross-sectional view to consist of a front cover 4, a back cover 2 and pages 3. Back cover 2 has a stiffener 11. Upper puppet element 14*a* has legs 7 mounted co-planar with stiffener 11. Lower puppet element 15*a* has legs 9 mounted co-planar with stiffener 11. Upper hole 5 and lower hole 6 are each defined to penetrate all the way through back cover 2, pages 3, and front cover 4. Holes 5, 6 are separated by gap area 17, thereby creating on front cover 4 and on each page an upper graphics area 16, a gap area 17 and a lower graphics area 18. Gap area 17 has a nominal height, h, of about 0.5 to about 2.0 inches. Puppet element 14*a* consists of inner layer 12 and decorative outer layer 8. Puppet element 15*a* consists of inner layer 13 and decorative outer layer 10. Preferably inner layers 12, 13 are made of a pliable material such as rubber. Decorative outer layers 8, 10 of puppet elements 14*a*, 15*a*, respectively, can be of various textures, designs, colors, shapes, and sizes.

Figure 2:
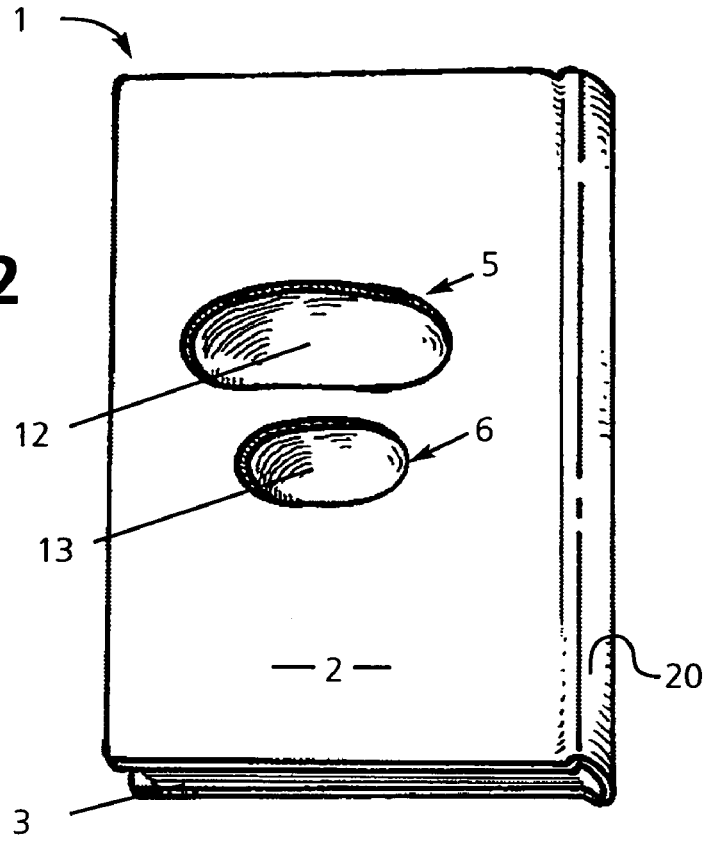
FIG. 2 is a back perspective view of the puppet book shown in FIG. 1.
Figure 2A:
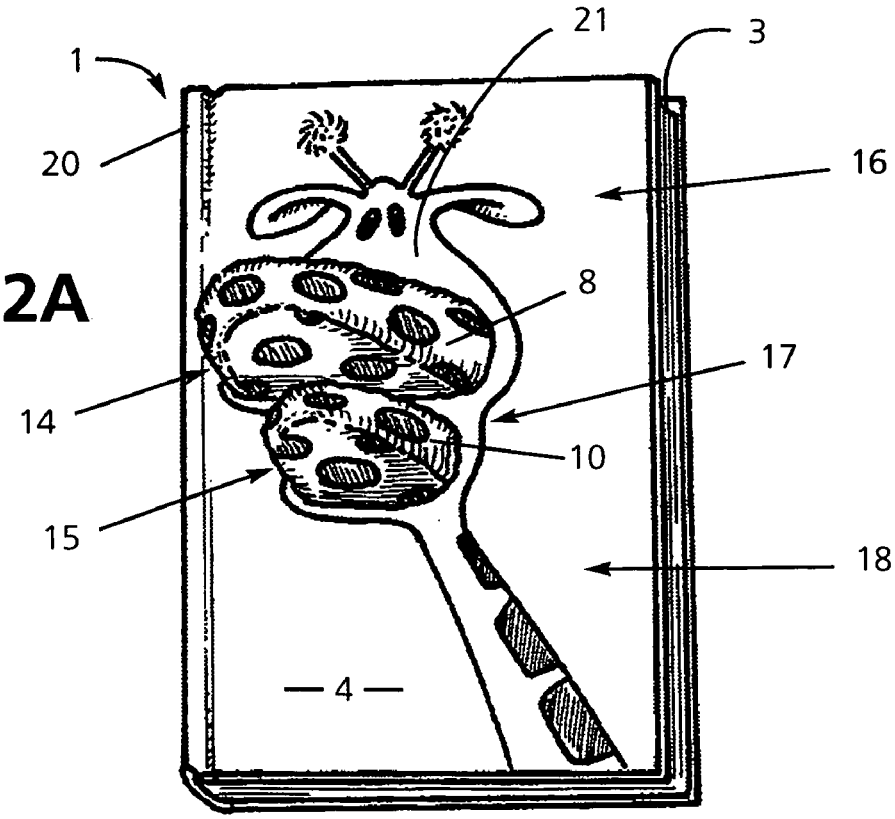
FIG. 2A is a front perspective view of the puppet book shown in FIG. 1.
Figure 12:
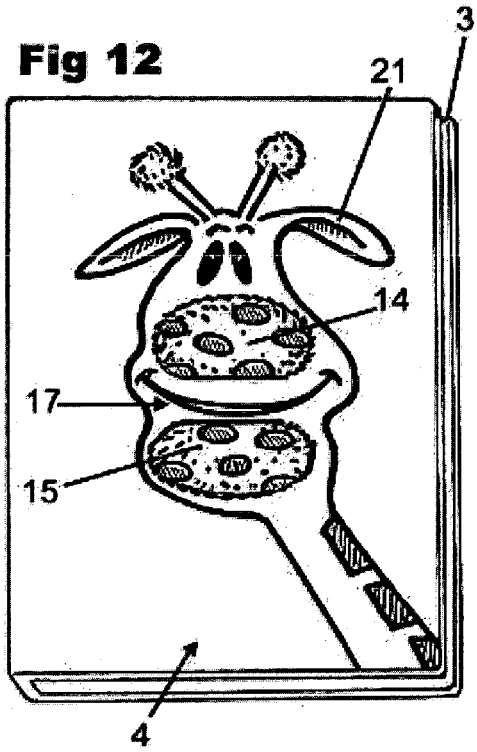
FIG. 12 is a front perspective view of an embodiment of the puppet book.
Figure 12A:
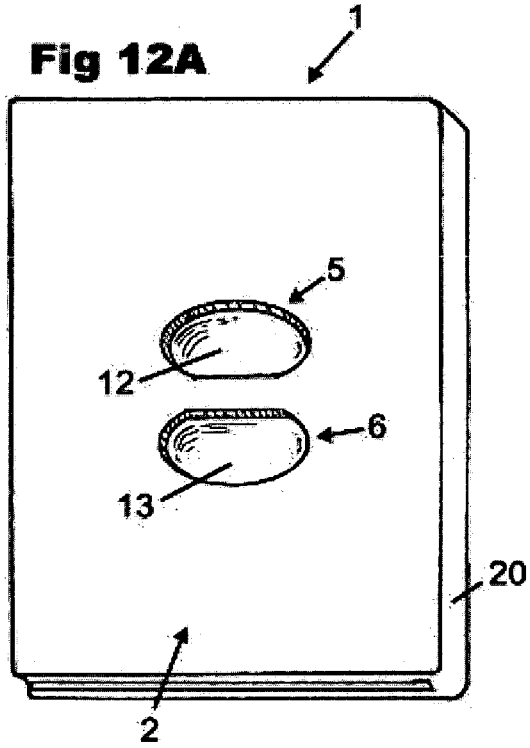
FIG. 12A is a back perspective view of the puppet book shown in FIG. 12.

Referring next to FIGS. 2, 2A, puppet book 1 has a spine 20 and back 2. Front cover 4 has a graphic character 21 which, in this example, is a giraffe having upper lip 14 and lower lip 15. Graphic character 21 spreads across all three areas, or upper graphics area 16, gap area 17, and lower graphics area 18. In this example, gap area 17 is decorated as the inside of a mouth. The giraffe character is offered by way of example and not of limitation; any graphic character means could be employed. Further, gap area 17 may be used to illustrate a character's face in various ways. As shown in FIGS. 2, 2A, upper lip 14 and lower lip 15 are of different shapes and sizes. However, if desired, upper lip 14 and lower lip 15 could be similar in size, as shown in the embodiment set forth in FIGS. 12, 12A. Alternatively, a lower lip could be larger than an upper lip (not shown).

Figure 3:
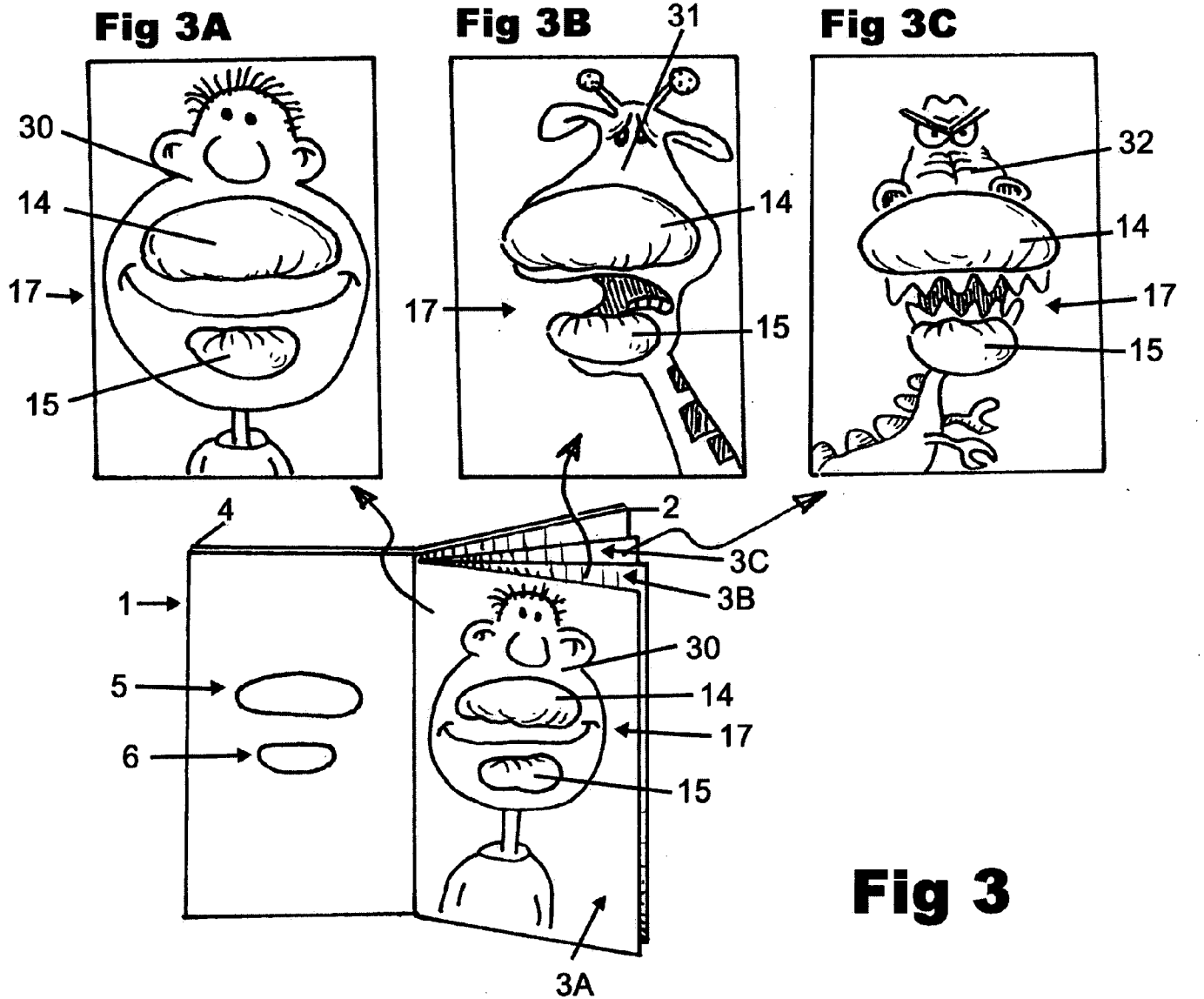
FIG. 3 is a front perspective view of the puppet book of FIG. 1 with the pages open.
Figure 13A:
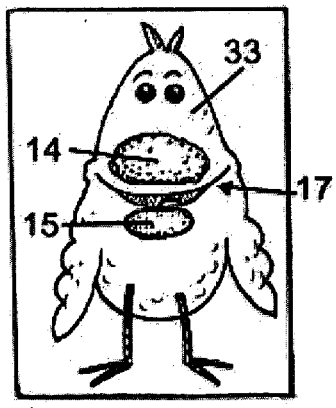
FIG. 13A is a front plan view of a puppet book page wherein a graphic character embodiment is shown having a happy expression.
Figure 13B:
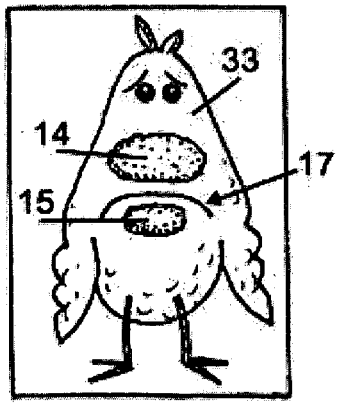
FIG. 13B is a front plan view of a puppet book page wherein a graphic character embodiment is shown having a sad expression.
Figure 13C:
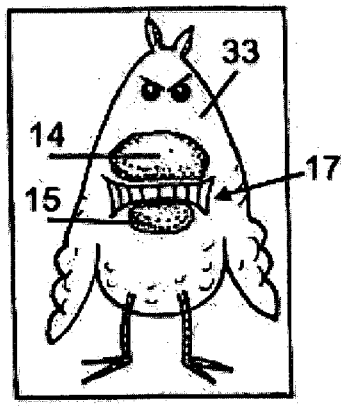
FIG. 13C is a front plan view of a puppet book page wherein a graphic character embodiment is shown having an angry expression.

Referring next to FIGS. 3, 3A, 3B, 3C, puppet book 1 has pages 3A, 3B, 3C. The three-page puppet book of the disclosed embodiment is offered by way of example and not of limitation as puppet book 1 may have more or fewer pages in various sizes and shapes. Each page 3A, 3B, 3C depicts a different graphic character. Character 30 is a man. Character 31 is a giraffe. Character 32 is an alligator. As shown in FIGS. 13A, 13B, 13C, character 33 is a bird. Each gap area 17 is used to decorate a character's face in a different way but specific to that particular character. For example, in FIG. 3A, gap area 17 depicts a facial characteristic on character 30, such as a smile. Similarly, a smile in gap area 17 of FIG. 13A depicts the happy expression of character 33. In FIG. 13B, wherein the gap area 17 contains a frown, character 33 can appear having a sad expression. By varying the expression in gap area 17 to show barred teeth, character 33 appears angry in FIG. 13C. In FIGS. 3B, 3C gap area 17 depicts an inner mouth of characters 31, 32. Relative to each upper lip 14, each lower lip 15 is shown having a different shape and size. However, if desired, each lip 14, 15 could be similar in size and shape (see FIG. 12).

An equivalent or alternate embodiment of the present invention (not shown) could be a three- or more holed embodiment, each hole having a puppet element or simply a hole to insert a finger therethrough.

Referring next to FIGS. 4, 4A, puppet book 1 is shown held by a reader's left hand 40 at front cover 4. When inserted through holes 5, 6 at back cover 2, the reader's right hand 41 can animate character 48 on page 42. The reader's right hand 41 can then turn page 42 in direction T as shown in FIG. 4A to expose a successive page 43. The reader's right hand 41 can then return to holes 5, 6, which penetrate back cover 2 and animate character 44 on page 43. Optionally, the reader's right hand can remain in the puppet element while the reader's left hand changes pages.

Figure 5:
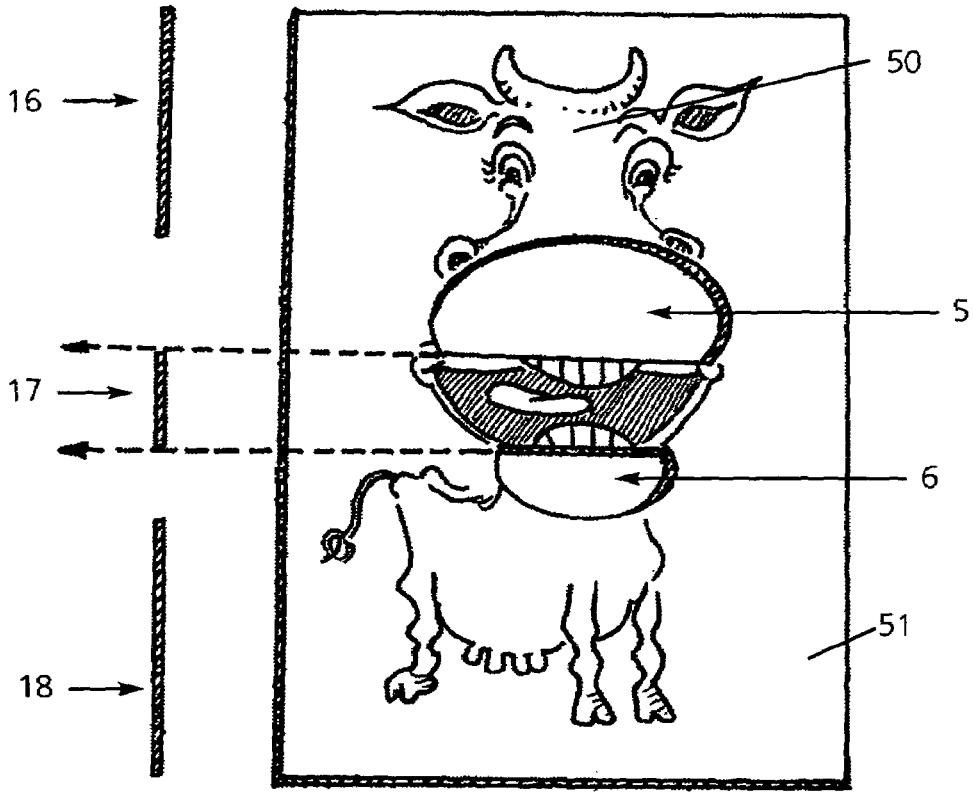
FIG. 5 is a front plan view of a page of the puppet book of FIG. 1 showing the gap area.

Referring next to FIG. 5, the puppet elements are not shown so as to provide better viewing of gap area 17. Page 51 of puppet book 1 is shown to have character 50 spread across upper graphics area 16, gap area 17, and lower graphics area 18. Gap area 17 has teeth, a tongue and inside mouth details specific to character 50. Upper hole 5 and lower hole 6 penetrate page 51 therethrough.

Figure 6:
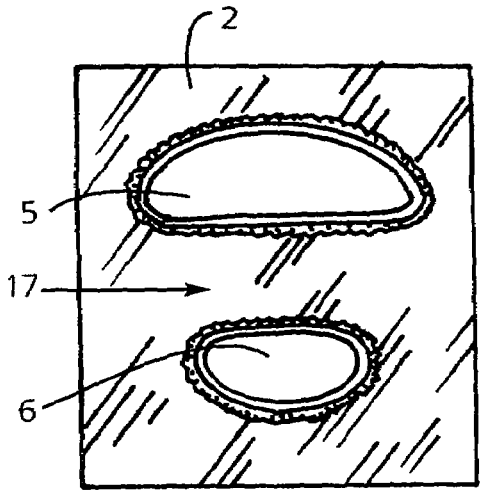
FIG. 6 is a rear plan view of a molded one-part puppet element shown in FIG. 6A.
Figure 6A:
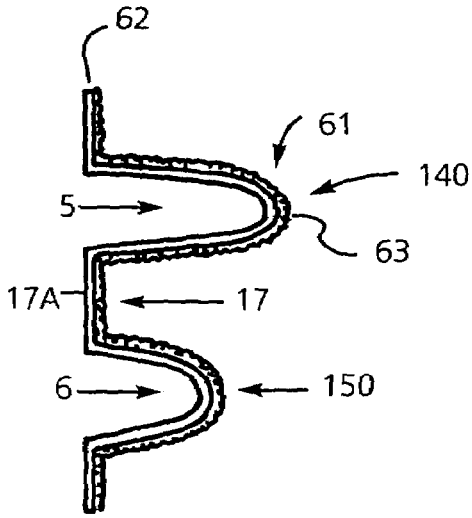
FIG. 6A is a side plan view of the one-piece puppet element shown in FIG. 6 which has two projections.

Referring next to FIGS. 6, 6A, an alternate embodiment puppet element 61 has an upper element 140 and a lower element 150. Although puppet element 61 is of a one-piece construction, puppet element 61 comprises two parts, or elements 140, 150. A layer 62 forms the structural basis for both elements 140, 150. A single outer layer 63 covers layer 62. Elements 140 and 150 are separated by gap area 17A. Upper hole 5 and lower hole 6 penetrate all the way through back cover 2 (see FIG. 6A), pages 3 (not shown), and front cover 4 (not shown). Holes 5, 6 are separated by gap area 17. In comparison with decorative outer layers 8, 10 of FIGS. 1, 2A, outer layer 63 may accommodate a variety of textures, colors, shapes, and sizes.

Figure 7:
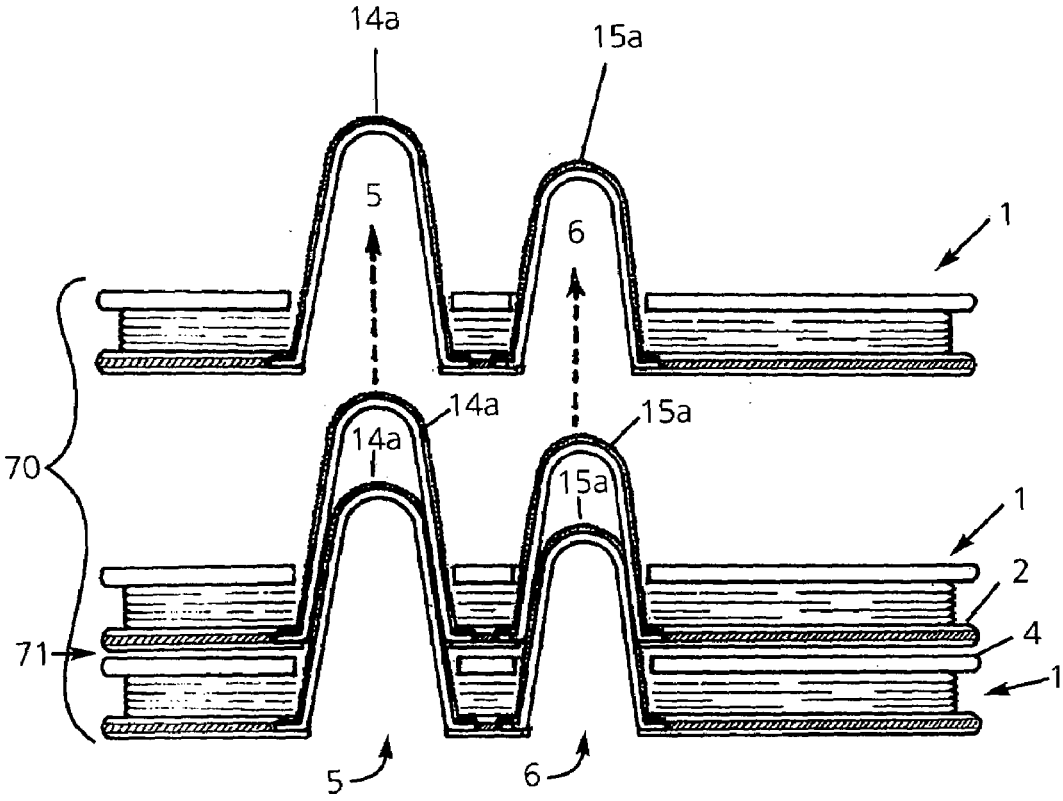
FIG. 7 is a side plan view of a stackable set of puppet books.

FIG. 7 illustrates the space saving stackable feature of set 70, which in this example comprises at least three units of puppet book 1. Set 70 consists of mounting puppet elements 14*a*, 15*a* of a puppet book 1 into holes 5, 6 of a subsequent puppet book 1. It can be seen that virtually no space is wasted at junction 71 between adjacent puppet books where front cover 4 of a puppet book 1 supports back cover 2 of a subsequent puppet book 1 in a flush manner.

Figures 8, 8A, 9, 9A, 10, 10A, 11, 11A:
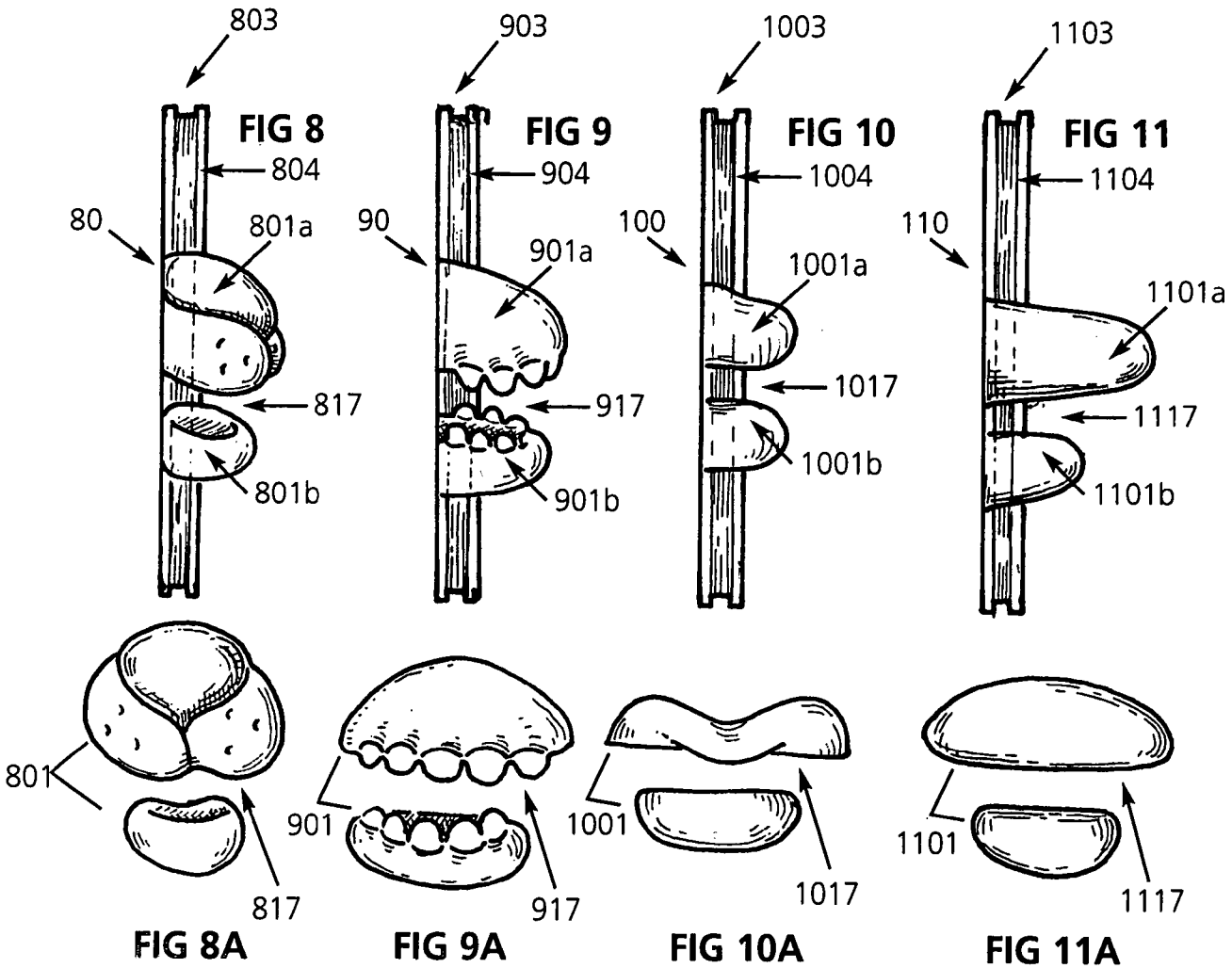
FIG. 8 is a side plan view of one type of puppet elements in a puppet book.
FIG. 8A is a front plan view of the puppet elements of FIG. 8.
FIG. 9 is a side plan view of one type of puppet elements in a puppet book.
FIG. 9A is a front plan view of the puppet elements of FIG. 9.
FIG. 10 is a side plan view of one type of puppet elements in a puppet book.
FIG. 10A is a front plan view of the puppet elements of FIG. 10.
FIG. 11 is a side plan view of one type of puppet elements in a puppet book.
FIG. 11A is a front plan view of the puppet elements of FIG. 11.

Referring next to FIGS. 8 through 1A, artistic variations for various books are shown. The disclosed variations are offered by way of example and not of limitation, as many other variations may be employed. Book 80 has puppet elements 801 comprising upper puppet element 801*a* and lower puppet element 801*b*. Gap area 817 between upper element 801*a* and lower element 801*b* is used to decorate a character's face that corresponds with front cover 804 or pages 803. Relative to puppet element 801*a*, puppet element 801*b* is shown having a different shape and size. In addition, puppet elements 801*a*, 801*b* could have different textures, decorations, and colors. Book 90 has puppet elements 901 comprising upper puppet element 901*a* and lower puppet element 901*b*. Gap area 917 between upper element 901*a* and lower element 901*b* is used to decorate a character's face that corresponds with front cover 904 or pages 903.

Book 100 has puppet elements 1001 comprising upper puppet element 1001*a* and lower puppet element 1001*b*. Gap area 1017 between elements 1001*a*, 1001*b* is used to decorate a character's face that corresponds with front cover 1004 or pages 1003. Book 110 has puppet elements 1101 comprising upper puppet element 1101*a* and lower puppet element 1101*b*. Gap area 1117 between elements 1101*a* and lower element 1101*b* is used to decorate a character's face that corresponds with front cover 1104 or pages 1103.

Just as in FIGS. 8, 8A, the various upper puppet elements depicted in FIGS. 9 to 11A, are shown having a corresponding lower puppet element with a different shape and size. Further, puppet elements 901, 1001, 1101 could have different textures, decorations, and colors. Puppet elements 801, 901, 1001, 1101 extend from a corresponding back cover, through corresponding pages, and through a corresponding front cover of puppet books 80, 90, 100, 110, respectively.

SUMMARY OF FEATURES

1. A 3-D mouth/nose element that when combined with appropriate surrounding artwork, can change character identity throughout an entire book (including the cover) with the turn of each page.
2. A 3-D mouth/nose element having two parts, one upper part and one lower part.
3. A 3-D mouth/nose element that accommodates a "gap" between two parts (upper and lower) that may be used to illustrate mouth parts and expressions.
4. A (changing) 3-D mouth/nose element that is operable and visible as a puppet throughout an entire book (including the cover) without the reader having to remove their hand.
5. A (changing) 3-D mouth/nose element that does not limit story writing to a single character.
6. A 3-D mouth/nose element that allows books (with and without the same content) to be stacked, one book on top of the other.
7. Holes through entire book.
8. Two holes on each page.

9. Two distinct elements.
10. Operable element throughout the entire book including the cover of the book.
11. Enter hand into puppet element on back cover of the book.
12. Hand may remain in element during the entire story.
13. Stackable for shipping and retailing.
14. Gap between upper and lower puppet element that enables the illustration of mouth parts and various facial expressions.
15. The artwork throughout the book is centered around the two elements and associated holes. The artwork and puppet elements combine to make the whole of the artwork throughout the entire book.
16. A single, two-part, 3-D Element may change character and/or expression on every page of a book.
17. The 3-D Element appears three-dimensional on the cover of book.

Although the present invention has been described with reference to various embodiments, numerous modifications and variations can be made and still the result will come within the scope of the invention. No limitation with respect to the specific embodiments disclosed herein is intended or should be inferred. Each apparatus embodiment described herein has numerous equivalents.

What is claimed is:

1. A three-dimensional book comprising:

a front cover, a rear cover, and a plurality of inner pages, all having at least two aligned holes therethrough;

said front cover, said rear cover, and each of said plurality of inner pages each having a gap between each of said holes;

a puppet element mounted to the rear cover, said puppet element projecting through each of said aligned holes;

wherein a user can insert a portion of a hand into said puppet element and animate it; and wherein said aligned holes further comprise an upper hole and a lower hole, wherein said upper hole is larger than said lower hole.

2. The book of claim 1, wherein said front cover, and some of said plurality of pages contains a graphic character that is coordinated with said puppet element.

3. The book of claim 2, wherein said gap of said front cover, and some of said plurality of inner pages contains an illustration of features coincident with the graphic character.

4. The book of claim 3, wherein said puppet element projecting through said upper hole represents a nose coincident with an upper portion of a mouth, and said puppet element projecting through said lower hole represents a lower portion of the mouth, and said front cover, and some of said plurality of inner pages are coordinated with said nose and upper portion of said mouth and said lower portion of said mouth.

5. The book of claim 3, wherein said illustration of mouth or facial features coincident with said graphic character contained in said gap may vary from human to animal to creature and may range from happy to sad to angry, and the like.

6. The book of claim 1, wherein the puppet element further comprises a pliable inner layer.

7. The book of claim 1, wherein the puppet element further comprises a decorative outer layer.

8. The book of claim 1, wherein the puppet element projecting through each of said aligned holes mounts into a pair of corresponding holes in a rear cover of a subsequent three-dimensional book, thereby providing a nestable configuration of at least two three-dimensional books.

9. The book of claim 1, wherein said puppet element is formed from a single member, thereby providing a one-piece structural base for said puppet element.

10. The book of claim 1, wherein said gap has a height of about 0.5 inch to about 2 inches.

11. The book of claim 1, wherein said rear cover further comprises a stiffener.

12. A three-dimensional book comprising:

a front cover, a rear cover, and a plurality of inner pages, each being decoratable with a graphic character distributed over an upper graphics area and a lower graphics area of said front cover, said rear cover, and each of said plurality of pages;

said front cover, said rear cover, and each of said plurality of inner pages having at least two aligned hole means therethrough functioning to project a portion of a puppet element means and a gap means between each of said hole means, said gap means functioning to separate an adjoining pair of hole means;

wherein said gap means is positioned between the upper graphics area and the lower graphics area of said front cover, said rear cover, and each of said plurality of inner pages;

said gap means further functioning to provide an illustratable area for mouth or facial features coincident with a graphic character depicted on the upper graphics area and the lower graphics area of said front cover, said rear cover, and each of said plurality of inner pages;

said puppet element means mounted to the rear cover and functioning to provide an animation means with a user moving a portion of said user's fingers therein;

said puppet element means having at least two parts, said parts having a hollow back interior, said puppet element means further functioning to provide a facial element coordinated with the graphic character depicted on the upper graphics area and the lower graphics area of said front cover, said rear cover, and each of said plurality of inner pages; and wherein each of said parts projects from the rear cover and through said inner pages to extend beyond the front cover through a respective hole means.

13. The book of claim 12, wherein each of said parts of said puppet element means further comprises a pliable inner layer means functioning to facilitate an animation of said puppet element means.

14. The book of claim 12, wherein each of said parts of the puppet element means further comprises a decorative outer layer means functioning to provide an appealing ornamental puppet surface.

15. The book of claim 12, wherein each of said parts of the puppet element means extending beyond the front cover mounts into a corresponding hole means in a rear cover of a subsequent three-dimensional book, thereby providing a nestable configuration of at least two three-dimensional books.

16. The book of claim 12, wherein said gap means has a height of about 0.5 inch to about 2 inches.

17. A three-dimensional book comprising:

a front cover, a rear cover, and a plurality of inner pages, all having at least two aligned holes therethrough;

said front cover, said rear cover, and each of said plurality of inner pages each having a gap between each of said holes;

a puppet element mounted to the rear cover, said puppet element having at least two parts, said parts having a hollow back interior;

wherein each of said parts projects from the rear cover and through said inner pages to extend beyond the front cover through a respective hole, thereby enabling a user to insert a portion of a hand into said hollow back interior of said parts to animate said puppet element;

wherein said front cover, said rear cover, and each of said plurality of pages is decoratable with a graphic character distributed over an upper graphics area, said gap, and a lower graphics area of said front cover, said rear cover, and each of said plurality of inner pages; and wherein said gap of said front cover, said rear cover, and each of said plurality of inner pages provides an area for an illustration of mouth or facial features coordinated with the graphic character depicted on the upper graphics area and the lower graphics area of said front cover, said rear cover, and each of said plurality of inner pages.

18. The book of claim 17, wherein each of said parts of the puppet element extending beyond the front cover mounts into a corresponding hole in a rear cover of a subsequent three-dimensional book, thereby providing a nestable configuration of at least two three-dimensional books.

19. A three-dimensional book comprising:

a front cover, a rear cover, and a plurality of inner pages, all having at least two aligned holes therethrough;

said front cover, said rear cover, and each of said plurality of inner pages each having a gap between each of said holes;

a puppet element mounted to the rear cover, said puppet element having at least two parts, each protruding through a respective hole, comprising a single member to provide a one-piece structural base for said puppet element, said parts having a hollow back interior and a gap between each of said parts of said puppet element;

wherein each of said parts projects from the rear cover and through said inner pages to extend beyond the front cover, thereby enabling a user to insert a portion of a hand into said hollow back interior of said parts to animate said puppet element;

wherein said front cover, said rear cover, and each of said plurality of pages is decoratable with a graphic character distributed over an upper graphics area and a lower graphics area of said front cover, said rear cover, and each of said plurality of inner pages; and wherein said gap of said front cover, said rear cover, and each of said plurality of inner pages provides an area for an illustration of mouth or facial features coincident with the graphic character depicted on the upper graphics area and the lower graphics area of said front cover, said rear cover, and each of said plurality of inner pages.

* * * * *